US007293890B2

(12) United States Patent
Chang

(10) Patent No.: US 7,293,890 B2
(45) Date of Patent: Nov. 13, 2007

(54) ELECTRONIC APPARATUS AND BUTTON DEVICE

(75) Inventor: En-Bair Chang, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 240 days.

(21) Appl. No.: 11/029,483

(22) Filed: Jan. 6, 2005

(65) Prior Publication Data

US 2005/0180123 A1 Aug. 18, 2005

(30) Foreign Application Priority Data

Feb. 13, 2004 (TW) ..... 93103556 A

(51) Int. Cl.
*F21V 5/00* (2006.01)

(52) U.S. Cl. ..... 362/85; 362/26; 362/327

(58) Field of Classification Search ..... 362/85, 362/28, 26, 327, 559; 345/168, 170, 176; 200/314

See application file for complete search history.

(56) References Cited

U.S. PATENT DOCUMENTS

| | | | | |
|---|---|---|---|---|
| 5,711,588 | A * | 1/1998 | Rudisill | 362/30 |
| 6,092,903 | A * | 7/2000 | Higgins, Jr. | 362/30 |
| 6,776,497 | B1 * | 8/2004 | Huppi et al. | 362/85 |
| 7,090,368 | B2 * | 8/2006 | Oross et al. | 362/84 |
| 2004/0233659 | A1 * | 11/2004 | Chen | 362/85 |

* cited by examiner

*Primary Examiner*—Stephen F. Husar
*Assistant Examiner*—Peggy A. Neils
(74) *Attorney, Agent, or Firm*—Birch, Stewart, Kolasch & Birch, LLP

(57) ABSTRACT

A button device, which is disposed beside a display unit, comprises at least a button unit. The button unit includes a first part, a second part, and a third part. In this case, the second part is adjacent to the first part. At least a light beam emitted from the display unit passes through the second part. The third part faces the first part. At least a light beam passing through the second part is transmitted to the third part, and then the light beam transmitted to the third part is reflected by the third part and passes through the first part.

20 Claims, 5 Drawing Sheets

ELECTRONIC APPARATUS AND BUTTON DEVICE

BACKGROUND OF THE INVENTION

1. Field of Invention

The invention relates to an electronic apparatus and button device, and, in particular, to an electronic apparatus and button device, which has a reflective layer and can reflect light beams from a display for illuminating the button device.

2. Related Art

Along with being in widespread use, electronic apparatuses can be applied in many situations. Among a variety of input devices of electronic apparatuses, the keyboard is the most common input device. For identifying and using buttons of the keyboard effectively in the dusky light or darkness, the prior art disclosed an illuminating keyboard.

As shown in FIG. 1 and FIG. 2, the conventional illuminating keyboard 1 includes a LED light source 11, a plurality of buttons 13 and a light guide plate 14. In this case, the LED light source 11 can be driven by a power wire 12. The buttons has a cover plate 131, a keycap 132 and a rubber layer 133. The light guide plate 14 guides the light emitted from the LED light source 11 and reflects it to the transparent area of the illuminating keyboard 1, which makes the illuminating keyboard illuminates uniformly.

The conventional illuminating keyboard 1 needs an extra light emitting member and its complicated circuits, as a result, the production process is more difficult, too. Besides, if the light emitting member is broken, the keyboard can't achieve the effect of illumination. Consequently, how to make an illuminating button device without an extra light emitting member and its complicated circuits and still having enough light for users to identify is an unsolved problem.

As described above, it is an important subjective to provide an electronic apparatus and button device for solving the above-mentioned problems.

SUMMARY OF THE INVENTION

In view of the foregoing, this invention is to provide an electronic apparatus and a button device, which has a reflective layer and can reflect light emitted from a display unit.

To solve the above-mentioned problems, a button device, which is disposed beside a display unit, comprises at least a button unit. The button unit includes a first part, a second part, and a third part. In this case, the second part is adjacent to the first part. At least a light beam transmitted from the display unit passes through the second part. The third part faces the first part. At least some he incident light is transmitted to the third part, and then the light beam is reflected to the first part by the third part The invention further provides an electronic apparatus, which includes a display unit, and at least a button unit. The button unit includes a first part, a second part, and a third part. In this case, the second part is adjacent to the first part. At least a light beam transmitted from the display unit passes through the second part. The third part faces the first part. At least some incident light beams is transmitted to the third part, and then the light beam is reflected to the first part by the third part.

As mentioned above, the button device and electronic apparatus of the invention utilize the light beam pervious material to make the button unit. The light beam emitted from the display unit is transmitted to the button unit. After being refracted to the reflective layer, at least a light beam is reflected to the character displaying area, and forms an illuminating button. As a result, users can clearly identify the characters on the button. Compared to the prior art, the button device and electronic apparatus of the invention need not add extra light emitting member and its complicated circuits. Therefore, users will not worry about the darkness of the keyboard owing to a broken light emitting member. Moreover, the electric power for the extra light emitting member can be saved.

BRIEF DESCRIPTION OF THE DRAWINGS

The invention will become more fully understood from the detailed description given herein below illustrations only, and thus is not limitative of the present invention, and wherein.

DETAILED DESCRIPTION OF THE INVENTION

Figure 1:
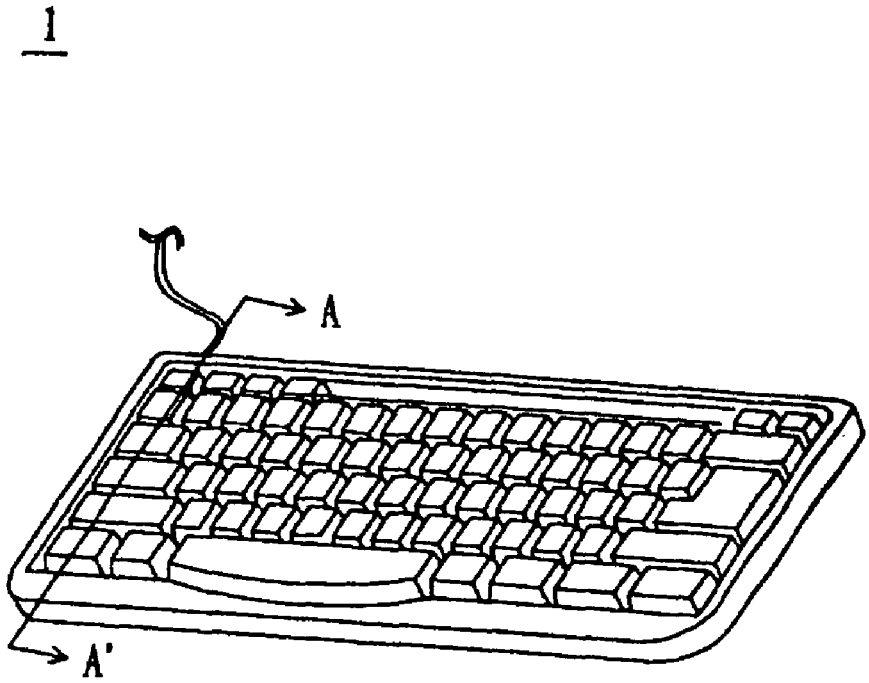
PRIOR ART FIG. 1
FIG. 1 is a schematic view of the conventional illuminating keyboard.
Figure 2:
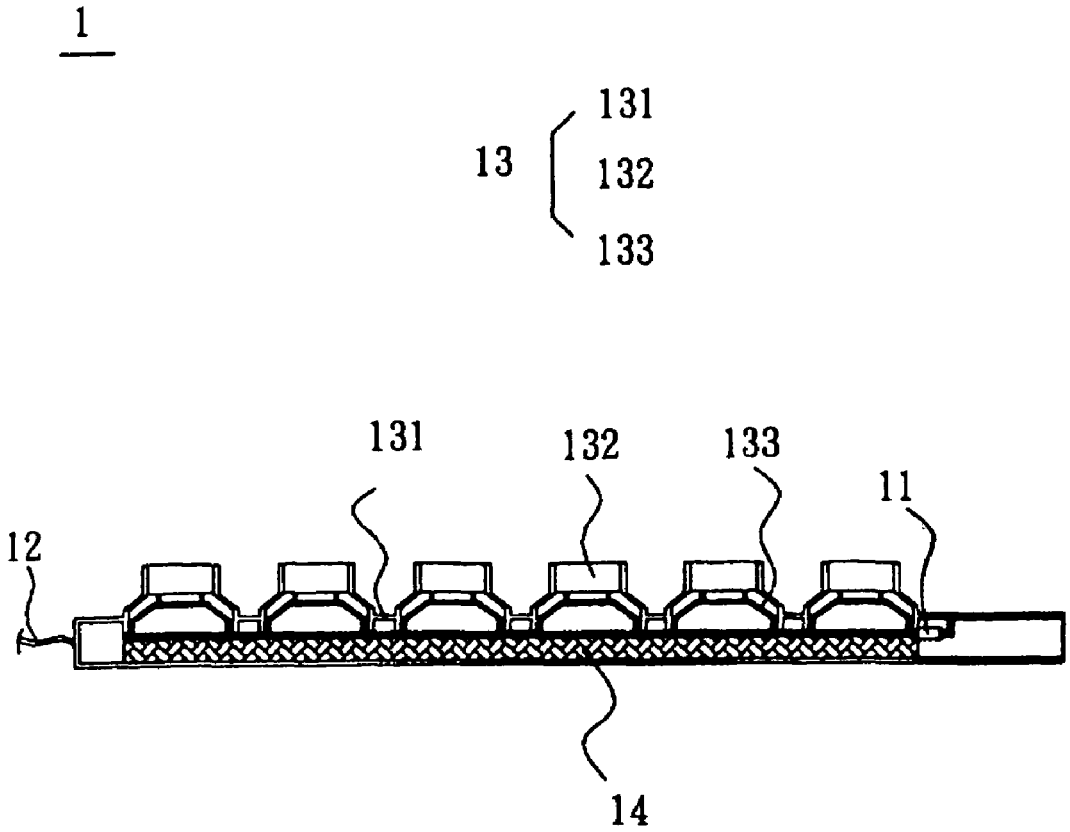
PRIOR ART FIG. 2
FIG. 2 is a cross-sectional view of the illuminating keyboard along the A-A' line in the FIG. 1.

The button device and electronic apparatus according to preferred embodiments of the invention will be described herein below with reference to the accompanying drawings, wherein the same reference numbers refer to the same elements.

First, referring to FIG. 3, the button device according to a preferred embodiment of the invention will be described.

The button device, which is disposed beside a display unit 21, includes at least a button unit 22. In the preferred embodiment, the button device includes a plurality of button units 22. The button unit 22 is disposed in the button device. In this case, the button device is the buttons of a laptop computer.

The display unit 21 is a display, such as a liquid crystal display (LCD) or an organic electroluminescence device (OLED). In the current embodiment, the display of the laptop is an example to display unit 21. Certainly, the display unit 21 could be a display of the personal computer.

The button unit 22 is formed integrally. It is made of the material selected from at least one of Acrylonitrile-Butadiene-Styrene copolymer (ABS copolymer), polycarbonate (PC), poly methyl methacrylate (PMMA) and Polyacrylate. Moreover, the button unit 22 can interact with a switch unit As shown in FIG. 3, the button unit 22 further includes a first part 221, a second part 222, and a third part 223. In this case, the first part 221 is positioned at a top surface of the button unit 22. The top surface is a pressing surface of the button unit 22. Pressing the first part 221 changes the height of the button unit 22 and triggers the switch under the button. The first part 221 further includes a character displaying area 224. When the light beam is transmitted from the first part 221, the character displaying area 224 is illuminated. Then, the user can identify the characters in the character displaying area 224.

Figure 4:
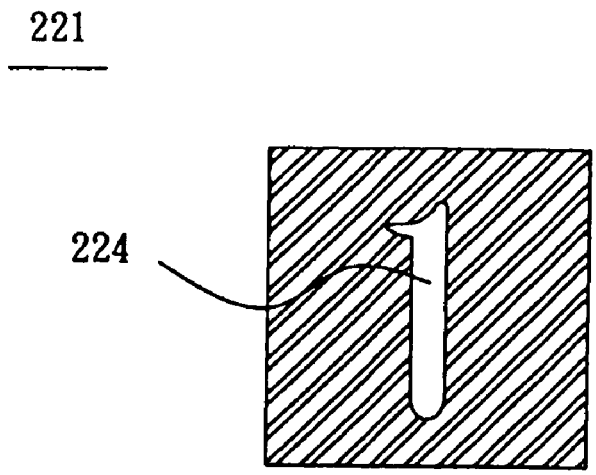
FIG. 4 is a schematic view of the character displaying area of the button device of the invention.

According to FIG. 4, forming a character displaying area 224, such as a number "1", on the first part 221 is by printing or coating. In the current embodiment, the opaque pigment is printed or coated on the slash area, and the light beam pervious pigment is printed or coated on the number "1" area. Additionally, the illuminating material, such as the light beam pervious material mixing with a fluorescence powder, is printed or coated on the number "1" area. When the light beam passes through the character displaying area 224 of the first part 221, the light beam can be emitted from the place, where it has light pervious pigment or illuminating material. As a result, the illuminating number "1" in the character displaying area 224 can be identified by the users.

Figure 5:
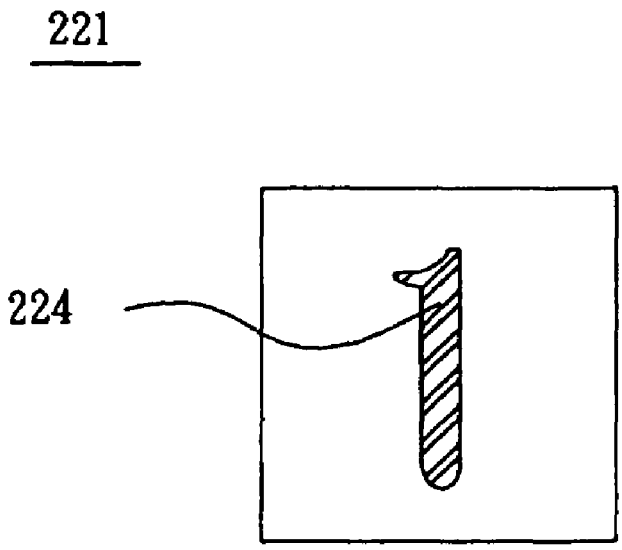
FIG. 5 is another schematic view of the character displaying area of the button device of the invention.

According to FIG. 5, the opaque pigment is printed or coated on the number "1" (slash area), and light pervious pigment is printed or coated on the area other than the number "1". Consequently, when light passes through the first part 221, the light beam can be emitted from the area other than character displaying area 224, the number "1". Then, the users can identify the characters on the character displaying area 224.

Figure 6:
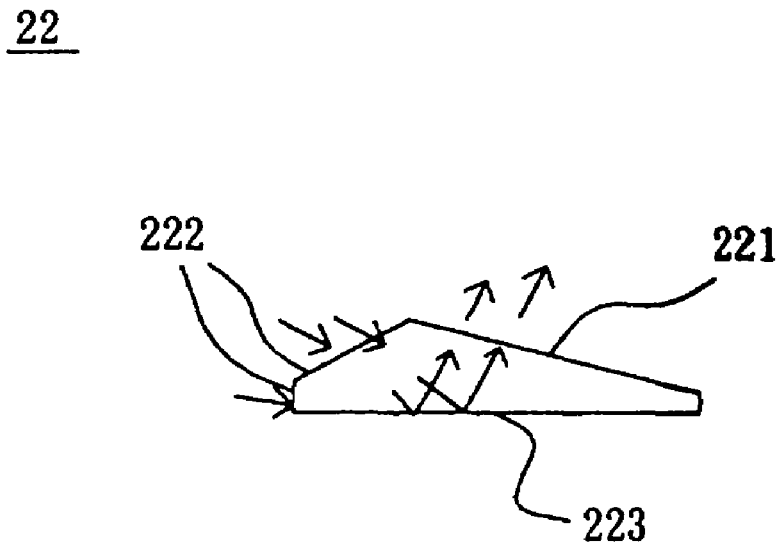
FIG. 6 is a schematic view of the button unit of the invention.

Referring to FIG. 6, the second part 222 is adjacent to the first part 221. At least a light beam emitted from the display unit 21 passes through the second part 222. The second part 222 at least has a surface. In the current embodiment, the second part 222 has two surfaces. The second part 222 is made of light pervious material, and the light beam emitted from the display unit 21 passes through the second part 222 then refracts to the third part 223.

Figure 7:
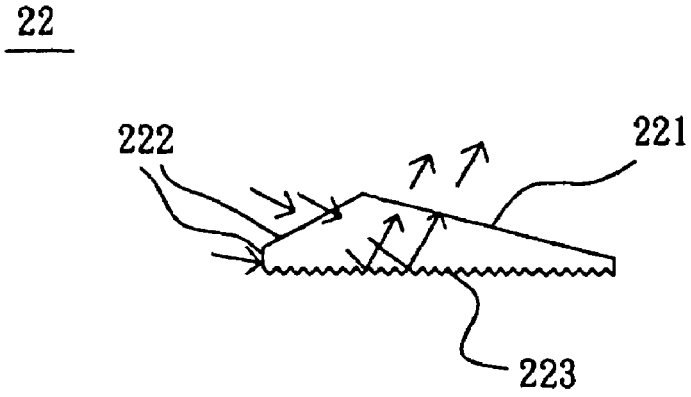
FIG. 7 is another schematic view of the button unit of the invention.

The third part 223 is adjacent to the second part 222 and faces to the first part 221. At least a light beam passing through the second part 222 is transmitted to the third part 223, and then the light beam transmitted to the third part 223 is reflected by the third part 223 and passes through the first part 221. The third part 223 is a reflective layer or a mirror. As shown in FIG. 7, the third part 223 can be a saw-like or wave-like surface. The light beam transmitted to the third part 223 is reflected immediately to the first part 221 by the third part 223, then, the light beam is transmitted from the first part 221 out of the button. Moreover, when the surface of third part 223 is saw-like or wave-like, other processes could be added to combine the integral first part 221 and the second part 222.

Secondly, referring to FIG. 8 and FIG. 3, the electronic apparatus 2 according to a preferred embodiment of the invention will be described.

Figure 8:
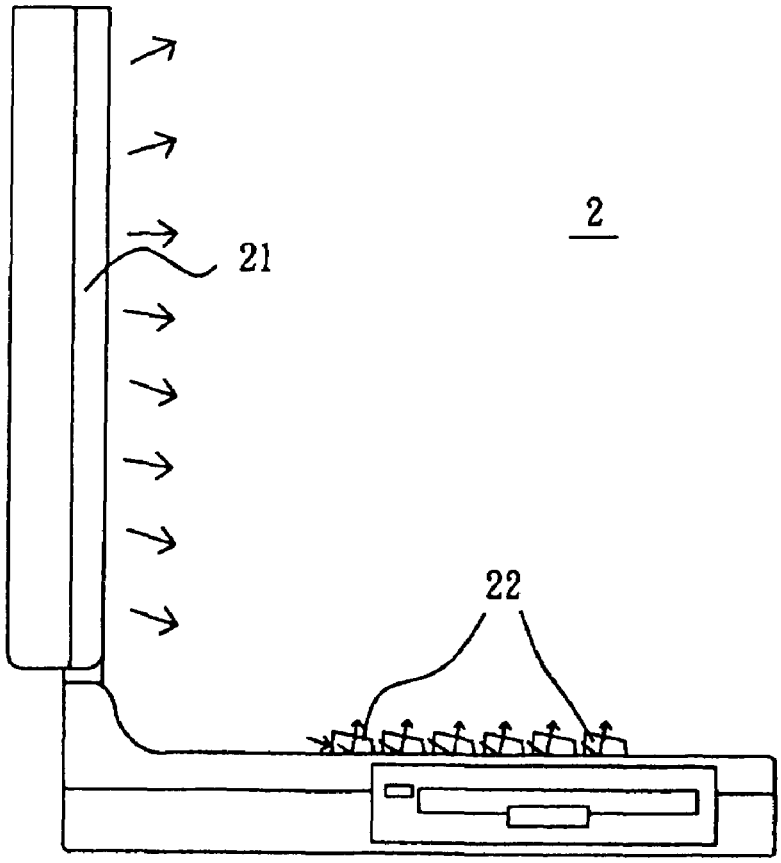
FIG. 8 is a schematic view of the electronic apparatus of the invention.

Referring to FIG. 8, the electronic apparatus 2 includes a display unit 21 and at least a button unit 22. In this case, the electronic apparatus 2 is a laptop computer.

The button unit 22 is disposed in the apparatus 2. The button unit 22 further includes a first part 221, a second part 222, and a third part 223.

The display unit 21 is a display, such as a liquid crystal display (LCD) or an organic electroluminescence device (OLED). In the current embodiment, the display of the laptop computer is an example to display unit 21. Certainly, the display unit 21 could be a display of the personal computer.

The button unit 22 is formed integrally. It is made of the material selected from Acrylonitrile-Butadiene-Styrene copolymer (ABS copolymer), polycarbonate (PC), poly methyl methacrylate (PMMA) and Polyacrylate. Moreover, the button unit 22 can interact with a switch unit.

Figure 3:
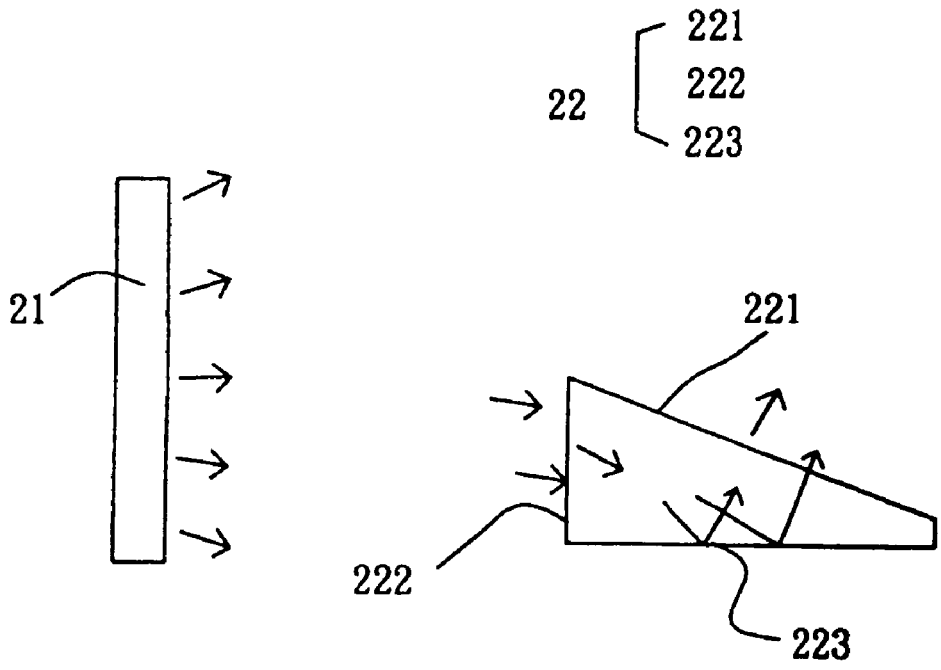
FIG. 3 is a schematic view of the button device of the invention.

As shown in FIG. 3, the button unit 22 further includes a first part 221, a second part 222, and a third part 223. In this case, the first part 221 is disposed at the top surface of the button unit 22. The top surface is a pressing surface of the button unit 22. Pressing the first part 221 changes the height of the button unit 22 and triggers the switch under the button. The first part 221 further includes a character displaying area 224. When the light beam is transmitted from the first part 221, the character displaying area 224 is illuminated. As a result, the user can identify the characters in the character displaying area 224.

According to FIG. 4, forming a character displaying area 224, such as a number "1", on the first part 221 is by printing or coating. In the current embodiment, the opaque pigment is printed or coated on the slash area, and the light beam pervious pigment is printed or coated on the number "1" area. Additionally, the illuminating material, such as the light beam pervious material mixing with a fluorescence powder, is printed or coated on the number "1" area. When the light beam passes through the character displaying area 224 of the first part 221, the light beam can be emitted from the place, where it has light pervious pigment or illuminating material. Then, the illuminating number "1" in the character displaying area 224 can be identified by the users.

According to FIG. 5, the opaque pigment is printed or coated on the number "1" (slash area), and light pervious pigment is printed or coated on the area other than the number "1". Consequently, when light passes through the first part 221, the light beam can be emitted from the area other than character displaying area 224, the number "1". Then the users can identify the characters on the character displaying area 224.

Referring to FIG. 6, the second part 222 is adjacent to the first part 221. At least a light beam emitted from the display unit 21 passes through the second part 222. The second part 222 at least has a surface. In the current embodiment, the second part 222 has two surfaces. The second part 222 is made of light pervious material, and the light beam emitted from the display unit 21 passes through the second part 222 then refracts to the third part 223.

The third part 223 is adjacent to the second part 222 and the third part 223 faces to the first part 221. At least a light beam passing through the second part 222 is transmitted to the third part 223, and then the light beam transmitted to the third part 223 is reflected by the third part 223 and passes through to the first part 221. The third part 223 is a reflective layer or a mirror. As shown in FIG. 7, the third part 223 can be a saw-like or wave-like surface. The light beam transmitted to the third part 223 is reflected immediately to the first part 221 by the third part 223, then, the light beam is transmitted from the first part 221 out of the button. Moreover, when the surface of third part 223 is saw-like or wave-like, other processes could be added to combine the integral first part 221 and the second part 222.

As mentioned above, the button device and electronic apparatus of the invention utilize the light beam pervious material to make the button unit. The light beam emitted from the display unit is transmitted to the button unit. After being refracted to the reflective layer, at least a light beam is reflected to the character displaying area, and forms an illuminating button. As a result, users can clearly identify the characters on the button. Compared to the prior art, the button device and electronic apparatus of the invention need not add extra light emitting member and its complicated circuits. Therefore, users will not worry about the darkness of the keyboard owing to a broken light emitting member. Moreover, the electric power for the extra light emitting member can be saved.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A button device, which is disposed beside a display unit and comprises at least a button unit, the button unit comprising:

a first part disposed at the top surface of the button unit;

a second part adjacent to the first part, wherein at least a light beam emitted from the display unit passes through the second part; and a third part faces the first part, wherein the light beam passing through the second part is transmitted to the third part, and then the light beam transmitted to the third part is reflected by the third part and passes through the first part, wherein the display unit is a display panel.

2. The button device of claim 1, wherein the first part is a pressing surface of the button unit, and the button unit is triggered by pushing the first part.

3. The button device of claim 1, wherein the first part further includes a character displaying area.

4. The button device of claim 3, wherein the character displaying area is formed by printing or coating.

5. The button device of claim 1, wherein the light beam emitted from the display unit is refracted to the third part with the second part.

6. The button device of claim 1, wherein the third part is a reflective layer.

7. The button device of claim 1, wherein the third part is a mirror.

8. The button device of claim 1, wherein the third part is saw-like.

9. The button device of claim 1, wherein the third part is wave-like.

10. The button device of claim 1, wherein the first part and the second part are integrally formed and are connected to the third part.

11. A electronic apparatus, comprising:

a display unit; and at least a button unit, which is disposed beside the display unit, wherein the button unit includes:

a first part disposed at the top surface of the button unit, a second part adjacent to the first part, wherein at least a light beam emitted from the display unit passes through the second part, and a third part faces the first part, wherein at least a light beam passing through the second part is transmitted to the third part, and then the light beam transmitted to the third part is reflected by the third part and passes through the first part, wherein the display unit is a display panel.

12. The electronic apparatus of claim 11, wherein the first part is a pressing surface of the button unit, and the button unit is triggered by pushing the first part.

13. The electronic apparatus of claim 11, wherein the first part further includes a character displaying area.

14. The electronic apparatus of claim 13, wherein the character displaying area is formed by printing or coating.

15. The electronic apparatus of claim 11, wherein the light beam emitted from the display unit is refracted to the third part with the second part.

16. The electronic apparatus of claim 11, wherein the third part has a reflective layer.

17. The electronic apparatus of claim 11, wherein the third part is a mirror.

18. The electronic apparatus of claim 11, wherein the third part is saw-like.

19. The electronic apparatus of claim 11, wherein the third part is wave-like.

20. The electronic apparatus of claim 11, wherein the first part and the second part are integrally formed and are connected to the third part.

* * * * *